US005654654A

United States Patent [19]

Franklin

[11] Patent Number: 5,654,654

[45] Date of Patent: Aug. 5, 1997

[54] INSTRUMENTATION SYSTEM WITH COMBINED VOLTAGE AND CURRENT SOURCE

[75] Inventor: Michael R. Franklin, Travis County, Tex.

[73] Assignee: National Instruments Corporation, Austin, Tex.

[21] Appl. No.: 377,455

[22] Filed: Jan. 24, 1995

[51] Int. Cl.[6] ..... G05F 1/569

[52] U.S. Cl. ..... 327/103; 327/100; 327/403; 327/407; 324/158.1

[58] Field of Search ..... 324/158.1, 73.1; 327/100, 103, 403, 408, 509, 512, 407, 365

[56] References Cited

U.S. PATENT DOCUMENTS 5,039,934 8/1991 Banaska ..... 323/268

FOREIGN PATENT DOCUMENTS 8027427 2/1983 Japan ..... 327/103

*Primary Examiner*—Timothy P. Callahan
*Assistant Examiner*—Dinh T. Le
*Attorney, Agent, or Firm*—Conley, Rose & Tayon; Jeffrey C. Hood

[57] ABSTRACT

A combined voltage and current source for measurement systems including a single reference amplifier provided at the front end which receives a reference voltage for determining the level of the voltage or current source signal supplied at the output. CMOS switches or similar logic selects between current and voltage portions of the combined circuit. If the voltage function is selected, the reference amplifier controls a voltage regulator to maintain the output voltage approximately equal to the reference voltage applied at the input. If the current function is selected, the reference amplifier is configured as a voltage to current converter to establish a current through a precision resistor. A voltage follower circuit provides the current source signal referenced to a supply voltage for providing a positive current. In this manner, a single reference amplifier is used at the front end rather than two separate reference amplifiers provided in prior art. Reliable switch circuitry at the input replaces a relatively expensive and unreliable relay for switching between the voltage and current functions.

28 Claims, 3 Drawing Sheets

INSTRUMENTATION SYSTEM WITH COMBINED VOLTAGE AND CURRENT SOURCE

FIELD OF THE INVENTION

The present invention relates to measurement systems, and more particularly to a combined voltage and current source for a measurement system for providing excitation signals.

DESCRIPTION OF THE RELATED ART

Scientists and engineers often use data measurement and acquisition (DAQ) systems to perform a variety of functions, including laboratory research, process monitoring and control, data logging, analytical chemistry, tests and analysis of physical phenomena and control of mechanical or electrical machinery to name a few examples. Generally, a process being monitored or otherwise controlled, referred to as the unit under test (UUT), is interfaced to one or more hardware I/O (input/output) interface devices. The I/O interface options include instrumentation associated with the GPIB (general purpose interface bus), the VXI bus, the RS232 protocol as well as other signal conditioning logic as known to those skilled in the art.

DAQ systems typically include transducers for asserting and measuring electrical signals, signal conditioning logic to perform amplification, isolation, and filtering, and other hardware for receiving digital analog signals and providing them to a processing system, such as a personal computer. The processing system generally comprises a computer such as an IBM AT or IBM compatible computer system having an I/O bus and corresponding connectors or slots for receiving I/O boards. Typically, plug-in DAQ boards are plugged into the I/O slots of a computer system for interfacing with the other instruments for ultimately interfacing the UUT with the processing system. The computer may further include analysis hardware and software for analyzing and appropriately displaying the measured data.

One particular function of a DAQ system is to assert one or more excitation signals to a measurement circuit and measure the corresponding responses from the measurement circuit. One example of such a measurement circuit is shown in FIG. 2A which illustrates an electrical strain gauge for determining the amount of applied mechanical stress on an object resulting from bending, stretching, or the application of any compressive force. A bridge configuration is established using four legs of resistances, where one leg is a strain gauge transducer, which is a resistive transducer having a resistance proportional to the amount of strain applied. The remaining resistive legs are typically fixed resistors having a particular desired degree of accuracy. An excitation source voltage is applied to the input of the bridge (across opposite nodes) and a detection circuit is connected across the remaining nodes to measure the response of the strain gauge circuit. In this manner, a DAQ system applies a known excitation source voltage across the bridge and measures the corresponding voltage of the output amplifier for determining the resistance of the strain transducer. This in turn provides a measurement of the amount of strain applied to the transducer and thus to the UUT.

FIG. 2B illustrates another example of a measurement circuit for measuring temperature, such as the ambient temperature of the UUT. In this example, an excitation source current is applied to an RTD resistor, and a high impedance amplifier is used to measure the voltage across the RTD resistor to determine its resistance. The RTD resistor operates in a similar manner as a thermistor having a resistance proportional (or inversely proportional) to temperature. Therefore, a common function in DAQ systems is to provide a known excitation signal in the form of either a source voltage or source current for measuring parameters of the UUT or other process.

Traditionally, one circuit is provided within the DAQ system for asserting a voltage source signal while an entirely separate circuit is provided for asserting a current source signal. The voltage and current source signals may be applied to separate outputs, but are typically switched to a single output using a relay. For example, a plurality of programmable excitation outputs are typically provided on a DAQ system, where each output is further coupled to separate programmable voltage and current source circuits through a relay for switching between the voltage and current sources. The use of entirely different circuits for voltage and current sources is relatively expensive because of similar type circuitry redundant in each. For example, both voltage and current source circuits include a reference amplifier receiving a reference voltage from the DAQ system establishing the desired level of source voltage or current, respectively. Although a relay provides the desired isolation between the voltage and current source outputs, relays are rather expensive and unreliable. The reliability of relays, or lack thereof, is an important consideration in computer controlled DAQ systems, where relays are likely to be operated a substantial number of times in a relatively short time period.

It is desired, therefore, to simplify excitation source circuitry as well as increase efficiency and reduce costs.

SUMMARY OF THE INVENTION

A combined voltage and current source according to the present invention includes a single reference amplifier receiving a single reference voltage and provides two excitation source output signals, preferably on a single output. The reference voltage determines the level of either the source voltage or source current signal. A switch circuit receives one or more select signals for coupling the reference amplifier to either a current source circuit or a voltage source circuit. Thus, the switching function is performed at the input rather than at the higher power output, thereby increasing efficiency. The switch circuit preferably comprises low current CMOS switches or the like which are significantly less expensive yet substantially more reliable than relays. The current source circuit provides a source current corresponding to the reference voltage when connected to the reference amplifier. Similarly, the voltage source circuit applies a source voltage corresponding to the reference voltage when connected to the reference amplifier. In the preferred embodiment, the outputs of the voltage and current source circuits are connected together to provide a single output source signal.

The voltage circuit preferably includes a three terminal adjustable voltage regulator for converting the reference voltage into a corresponding voltage source signal. The reference amplifier is coupled in a manner to control the voltage level provided by the voltage regulator. An adjustable voltage regulator is used because it provides current limit and buffering functions to protect the measurement system from accidental shorts or high voltages at the output. When the current portion of the source circuitry is selected, the reference amplifier is coupled as a voltage to current converter, which is further coupled to a voltage follower type constant current amplifier for applying a current proportional to the reference voltage. The constant current amplifier references the current to a supply voltage source, thereby providing a positive current source signal to the UUT.

In this manner, a combined voltage and current source according to the present invention eliminates redundant circuitry and uses CMOS switches or similar logic circuitry to define the excitation function rather than an expensive and relatively unreliable relay to switch independent outputs. Thus, the present invention allows greater efficiency and reduced costs of a measurement system.

BRIEF DESCRIPTION OF THE DRAWINGS

A better understanding of the present invention can be obtained when the following detailed description of the preferred embodiment is considered in conjunction with the following drawings, in which.

DETAILED DESCRIPTION OF THE PREFERRED EMBODIMENT

Figure 1:
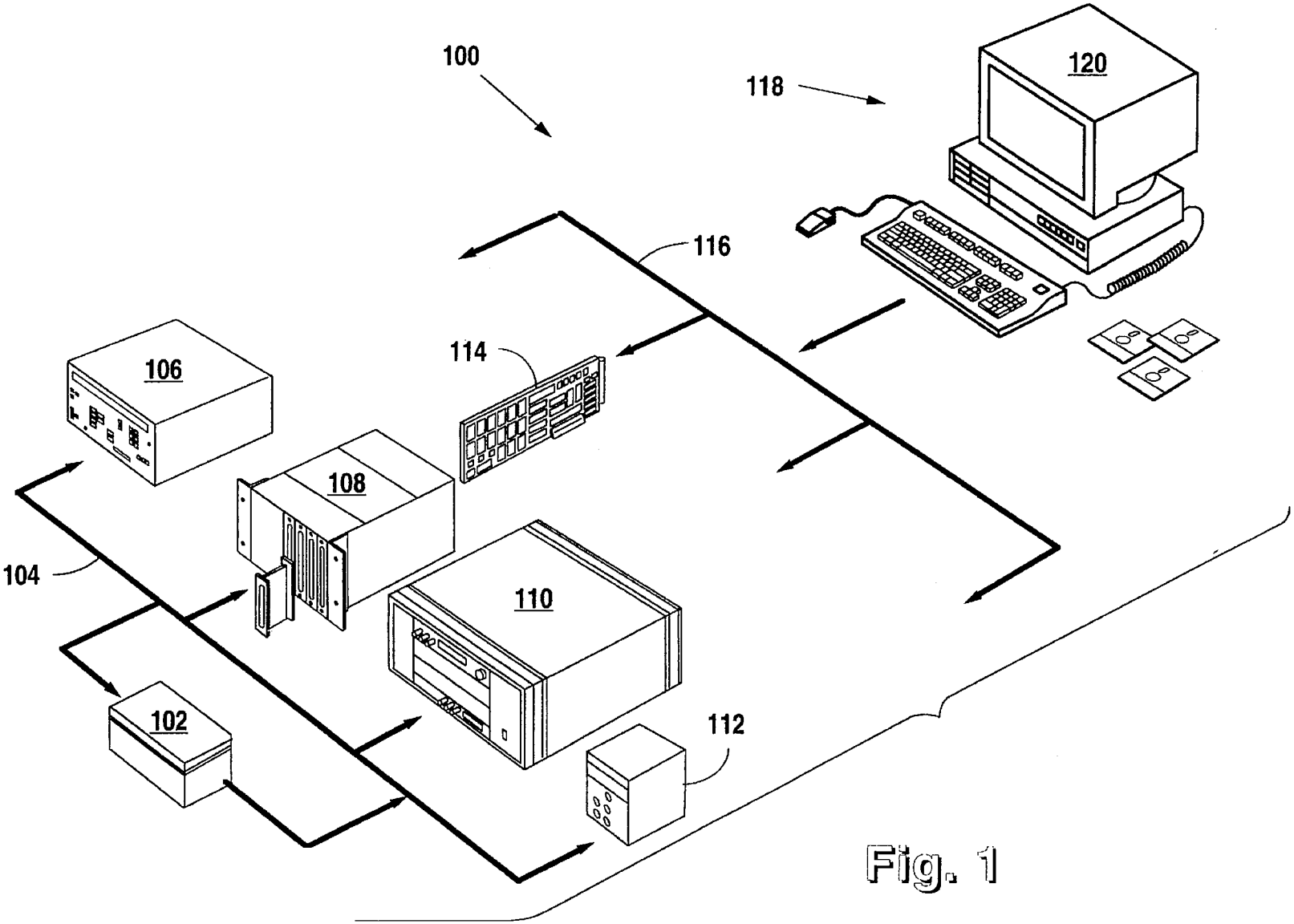
FIG. 1 is a perspective view of an instrumentation system according to the present invention.

Referring now to FIG. 1, a perspective diagram of a DAQ system 100 is shown including a combined voltage and current source according to the present invention. A unit under test (UUT) 102 generally represents a process or other physical phenomena being monitored or controlled, including transducers or other sensing devices for detecting or measuring temperature, pressure, voltage, strain, etc. The UUT 102 is coupled to one or more interface devices, such as a GPIB instrument 106, a signal conditioning device 108, a VXI instrument 110, or an RS232 instrument 112, through an interface bus 104. The various instrument devices 106, 108, 110, and 112 (106–112) generally isolate field signals provided from the UUT 102 and otherwise amplify, reduce, or filter the field signals and provide corresponding digital signals to a DAQ board 114 plugged into an I/O slot of computer system 118. Preferably, the DAQ board 114 is coupled to the I/O bus 116 of the computer system 118.

The DAQ board 114 includes a plurality of channels and appropriate circuitry for collecting all the data provided by the instrument devices 106–112 and providing this collected data to the I/O bus 116 of the computer system 118. The computer system 118 includes the appropriate software for performing analysis of the collected data as well as a display 120 for displaying the analyzed data in a desirable or understandable format. For purposes of the present invention, one or more of the instrument devices 106–112 assert source signals in the form of voltages or currents to the UUT 102 for measuring certain parameters. The combined voltage and current source according to the present invention may therefore be provided in any one of the instrument devices 106–112 or may further be provided in the plug-in DAQ board 114 as desired.

Figure 2A:
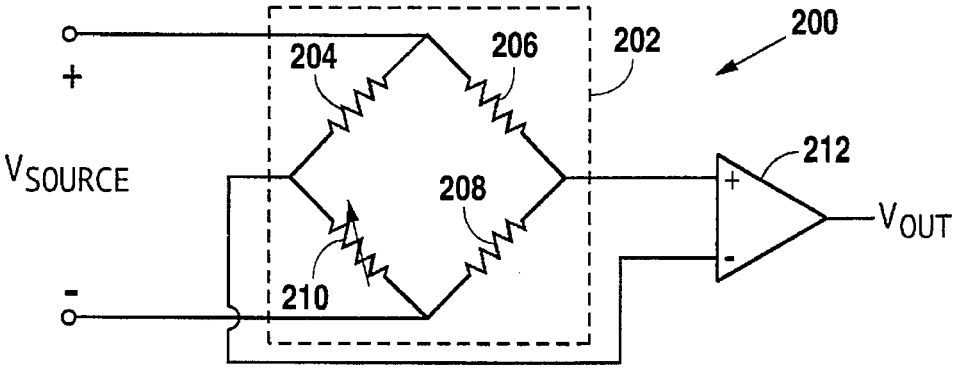
Fig. 2A ( PRIOR ART )
FIG. 2A is simplified schematic diagram of a strain gauge.

Referring now to FIG. 2A, a simplified schematic diagram is shown of a strain gauge 200 which could be used in the DAQ system 100 according to the present invention. Generally, a source voltage, referred to as $V_{SOURCE}$, is applied to the input terminals of a bridge circuit 202 which includes four resistive branches coupled in bridge configuration as known to those skilled in the skilled in the art. In particular, three resistors 204, 206 and 208 having known resistances comprise three of the branches and are usually precision resistors to obtain the desired accuracy. The fourth branch is preferably a strain transducer 210 having a resistance proportional to the amount it is deformed when subjected to a strain force, such as bending, stretching or a compression force. Thus, the strain gauge 210 itself is typically mounted within the UUT 102. A high impedance amplifier 212 is coupled to the output terminals of the bridge 202 for asserting an output voltage $V_{OUT}$ indicative of the resistance of the strain transducer 210. In this manner, a known source voltage $V_{SOURCE}$ is applied and the $V_{OUT}$ signal is measured, and a processing system, such as the computer 118, determines the corresponding resistance of the strain transducer 210 and calculates the amount of strain.

Figure 2B:
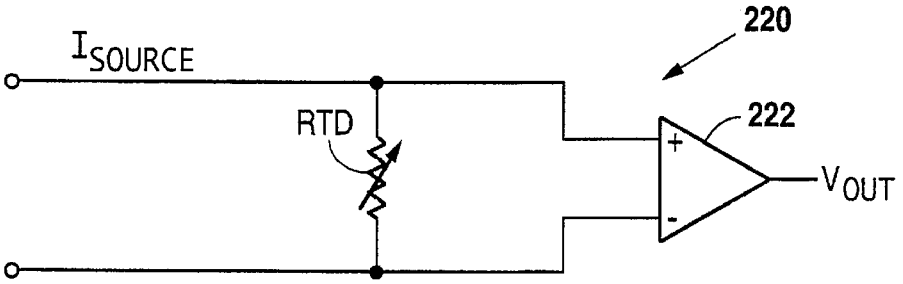
Fig. 2B ( PRIOR ART )
FIG. 2B is simplified schematic diagram of a temperature measurement circuit.

FIG. 2B illustrates temperature measurement circuit 220 for measuring the ambient temperature of the UUT 102 using an RTD resistor. In particular, a known current, referred to as $I_{SOURCE}$, is applied through the RTD resistor and a high impedance amplifier 222 has inputs coupled across the RTD resistor and an output for asserting an output signal $V_{OUT}$. It is noted that the RTD resistor may alternatively be replaced by any one of several types of transducers for measuring any one of a variety of parameters.

Figure 3:
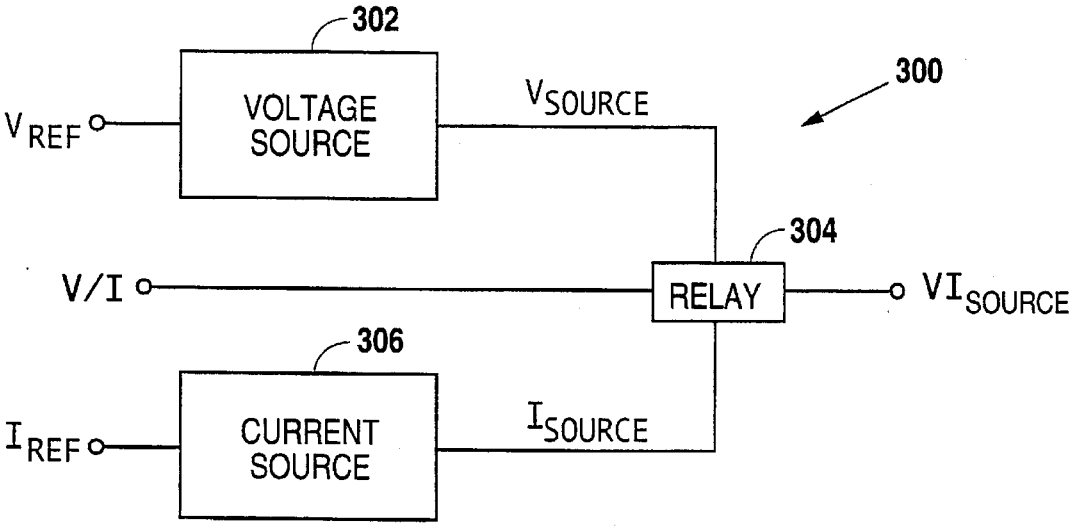
Fig. 3 ( PRIOR ART )
FIG. 3 is voltage and current source according to prior art.

Referring now to FIG. 3, a block diagram is shown of an excitation circuit 300 according to prior art. In general, a voltage source 302 receives a reference voltage $V_{REF}$ and asserts a corresponding voltage signal $V_{SOURCE}$ to one switched input of a relay 304. A separate current source 306 receives a reference voltage $I_{REF}$ and asserts a corresponding current signal $I_{SOURCE}$ to another switched input of the relay 304. The relay 304 receives a switch signal V/I for asserting either the $V_{SOURCE}$ or $I_{SOURCE}$ signal at its output, where the output source signal will be referred to as $VI_{SOURCE}$. In this manner, the V/I signal is asserted or negated for selecting either the $V_{SOURCE}$ signal or the $I_{SOURCE}$ signal, where the relay 304 asserts the corresponding selected signal $VI_{SOURCE}$ to a measurement circuit, such as those shown in FIGS. 2A or 2B or the like, for purposes of measurement as previously described. Thus, the excitation circuit 300 according to prior art includes two totally isolated voltage and current sections receiving separate reference voltage signals, $V_{REF}$ and $I_{REF}$. This results in duplication of circuitry and the added complication of having to assert two separate reference voltages while only one is necessary at any given time. The relay 304 is relatively expensive and not very reliable. When used in the DAQ system 100, such relays have limited lifespans since a significant amount of switching typically occurs over a relatively short period of time.

Figure 4:
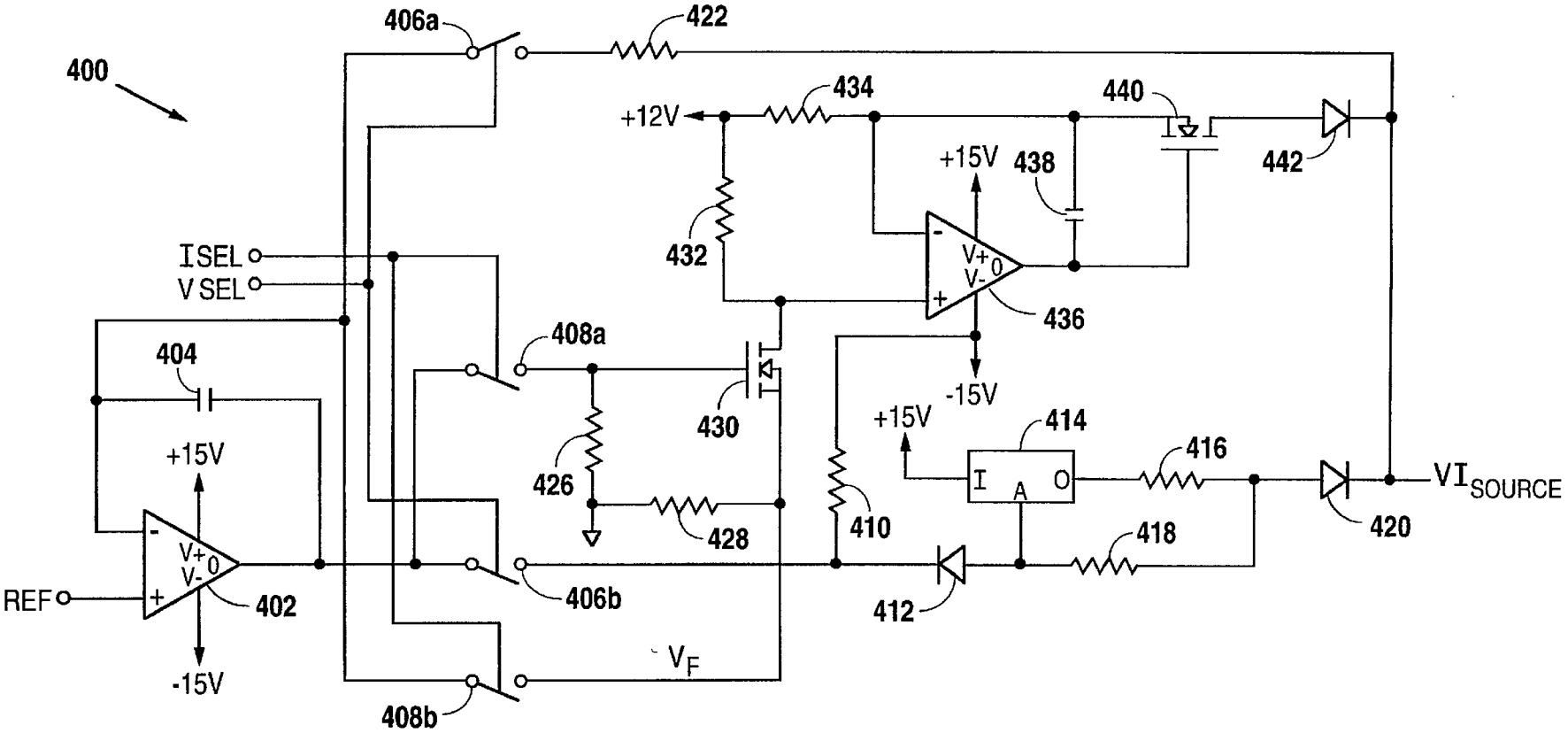
FIG. 4 is a combined voltage and current source according to the present invention.

Referring now to FIG. 4, a schematic diagram is shown of a combined voltage and current source 400 according to the present invention. A reference voltage signal, referred to as REF, is preferably asserted by an instrument device, such as one of the instrument devices 106–112 of FIG. 1, for determining the level of voltage or otherwise the amount of current required by a measurement circuit, such as the strain gauge 200 or the temperature measurement circuit 220. The REF signal is applied to the positive input of a reference amplifier 402, which is preferably the AD705SM manufactured by Analog Devices. A capacitor 404 is connected between the negative input and the output of the amplifier 402 for purposes of filtering and stability. The negative input of the amplifier 402 is provided an input terminal of a switch 406*a* and to the input terminal of another switch 408*b*. The output of the amplifier 402 is provided to the input terminal of a third switch 408*a* as well as to the input of a fourth switch 406*b*. A current select signal ISEL is provided to the control terminal of the switches 408*a* and 408*b* and a voltage select signal VSEL is provided to the control terminals of the switches 406*a* and 406*b*.

The switches 406*a*, 406*b*, 408*a*, and 408*b* are normally-open, single-pole, single throw switches which are closed when a signal is asserted on their control terminals. In particular, the switches 406*a* and 406*b* are closed when the VSEL signal is asserted and the switches 408*a* and 408*b* are closed when the ISEL signal is asserted. Of course, a single select signal could be used for switching between voltage and current functions. The switches 406*a,b* and 408*a,b* are preferably complimentary metal-oxide semiconductor (CMOS) switches which are significantly less expensive and yet substantially more reliable than relays. The CMOS switches 406*a,b* and 408*a,b* could be replaced with similar type logic circuitry for selecting the voltage or current functions.

When the VSEL signal is asserted, the voltage function is selected where the output of amplifier 402 is connected to one end of a resistor 410 and to the cathode of a diode 412. The other end of the resistor 410 receives a negative rail voltage of approximately 15 volts, referred to as the −15 V signal. The anode of the diode 412 is provided to the adjust input (A) of a three-terminal adjustable voltage regulator 414. The regulator 414 is preferably the LM317 manufactured by National Semiconductor, although other similar voltage regulators are contemplated. The input terminal (I) of the regulator 414 receives a positive 15 volt rail voltage, referred to as the +15 V signal. The output (O) of regulator 414 is connected to one end of a resistor 416, having its other end connected to one end of a resistor 418 and to the anode of a diode 420. The diode 420 is preferably a low leakage diode, such as the JPAD50 manufactured by Siliconix. The other end of the resistor 418 is connected to the adjust terminal of the regulator 414 and to the anode of the diode 412, and the cathode of the diode 420 provides the $VI_{SOURCE}$ signal. The cathode of diode 420 is connected to one end of a current limit resistor 422, having its other end connected to the output of the switch 406*a*, and thus, the negative terminal of the amplifier 402 when the VSEL signal is asserted.

The resistor 422 is provided to protect the switches 406*a,b* and 408*a,b* in the event an excessive voltage is applied at the output or through the $VI_{SOURCE}$ signal. The reference amplifier 402 attempts to maintain its negative and positive inputs equal by controlling the adjust input of the voltage regulator 414. In this manner, the voltage applied on $VI_{SOURCE}$ is kept approximately equivalent to the voltage of the REF signal. If the VSEL signal is not asserted so that the voltage portion is not selected, the diode 420 is reversed biased through the pull down resistor 410 to the −15 V voltage signal to isolate the voltage portion from the output and thus from the current portion. This isolation is further enhanced since the diode 420 is a low-leakage diode.

When the ISEL signal is asserted, the output of amplifier 402 is connected through switch 408*a* to one end of a resistor 426 and to the gate of an n-channel metal-oxide semiconductor field effect transistor (MOSFET) 430. Also, the switch 408*b* connects the negative input of the amplifier 402 to the source of the MOSFET 430 and to one end of a precision resistor 428, having its other end connected to ground. The drain of the MOSFET 430 is provided to one end of a resistor 432, having its other end connected to a positive supply voltage, which is preferably 12 volts and referred to as the +12 V signal. Thus, when the ISEL signal is asserted, the amplifier 402 is configured as a voltage to current converter which operates to keep the voltage at its negative input, referred to as a signal $V_F$, approximately equivalent to the voltage of the REF signal asserted at its positive input. In this manner, the amplifier 402 asserts its output to control the MOSFET 430 to maintain the $V_F$ signal approximately equal to the REF signal. This establishes a current through the resistor 428, which is preferably a 1% precision resistor having a resistance on the order of 10K ohms and having a low temperature coefficient of resistance (TCR). In this manner, when the REF signal has a voltage of between 0 and 10 volts, the current through resistor 428 is between 0 and 1 milliamp (mA).

The drain of the MOSFET 430 is also connected to the positive input of another amplifier 436 which is also preferably the AD705SM. The negative input of the amplifier 436 is connected to one end of a resistor 434, having its other end connected to the +12 V signal. The resistors 432 and 434 are preferably matched resistors having resistances approximately equivalent to each other, which track each other with changes in temperature. The negative input of amplifier 436 is also connected to one end of a filter capacitor 438 and to the source of a p-channel MOSFET 440. The output of the amplifier 436 is connected to the other end of the capacitor 438 and to the gate of the MOSFET 440. The drain of the MOSFET 440 is connected to the anode of a Schottky diode 442, having its cathode providing the $VI_{SOURCE}$ signal. The diode 442 is preferably a Schottky diode for low forward voltage drop, such as the CMPSH-3S by Central Semiconductor.

The resistor 426 serves to turn off the MOSFET 430 when the switch 408*a* is open. In operation, the current developed through the resistor 428 also flows through the resistor 432, which has a resistance approximately equal to the resistance of the resistor 434. The amplifier 436 controls the MOSFET 440 to maintain the current through resistor 434 approximately equal to the current flowing through resistor 432 to keep the voltage at its positive and negative inputs approximately equal. The current flowing through the resistor 432 also flows through the MOSFET 440 and the diode 442 to the output. Thus, the amplifier 436 performs as a voltage-follower constant current source, which converts the current flowing through the resistor 428 referenced to ground to a current source flowing through the resistor 434 referenced to the +15 V rail voltage. When the ISEL signal is negated so that the current portion is not selected, the MOSFET 440 and the diode 442 provide the desired isolation.

In this manner, a source voltage is asserted as the $VI_{SOURCE}$ signal when a reference voltage is asserted on the REF signal and the VSEL signal is asserted. Alternatively, a source current is provided through the $VI_{SOURCE}$ signal when the ISEL signal is asserted and a corresponding reference voltage is asserted on the REF signal. The switches 406*a,b* and 408*a,b*, the diodes 442, 420 and the MOSFET 440 serve to connect the selected source and also to isolate either or both sources from the output if the corresponding function is not selected. It is noted that in the embodiment shown, the $VI_{SOURCE}$ signal is isolated if neither voltage or current functions are selected.

It is now appreciated that a single reference amplifier is used rather than two separate amplifiers at the from end of a combined voltage and current source according to the present invention, so that redundant circuitry is eliminated. The reference amplifier is coupled to either a current source circuit or a voltage source circuit through low current CMOS switches, which are significantly less expensive and yet substantially more reliable than relays. Also, the switching function is provided at the relatively low power input rather than the higher power output thereby increasing efficiency. The present invention thus effectively reduces the costs and increases the efficiency of measurement systems.

Although the method and apparatus of the present invention has been described in connection with the preferred embodiment, it is not intended to be limited to the specific form set forth herein, but on the contrary, it is intended to cover such alternatives, modifications, and equivalents, as can be reasonably included within the spirit and scope of the invention as defined by the appended claims.

I claim:

1. A combined voltage and current source for a measurement system, comprising:

a reference amplifier receiving a reference voltage;

a current source circuit comprising:

an input for coupling to said reference amplifier;

an output for providing a source current corresponding to said reference voltage when coupled to said reference amplifier;

a first controlled switch having a control input and a first current path; and a reference resistor coupled to said first current path of said first controlled switch;

wherein said reference amplifier has an output coupled to said control input to control the current through said reference resistor;

a voltage source circuit having an input for coupling to said reference amplifier and an output for asserting a source voltage corresponding to said reference voltage when coupled to said reference amplifier; and a switch circuit coupled to the current source circuit and the voltage source circuit, the switch circuit receiving at least one select signal and coupled to said reference amplifier to select between said current source circuit and said voltage source circuit based on said select signal for coupling to said reference amplifier.

2. The combined voltage and current source of claim 1, wherein said current source circuit output and said voltage source circuit output are connected together to provide a single source signal depending on said select signal.

3. The combined voltage and current source of claim 1, wherein said reference amplifier is coupled as a voltage to current converter when coupled to said current source circuit for establishing a current signal corresponding to said reference voltage.

4. The combined voltage and current source of claim 1, wherein said current source circuit further comprises:

means for providing a supply voltage;

first and second matched resistors, wherein said first matched resistor is coupled between said first current path of said first controlled switch and said supply voltage;

a second controlled switch having a control terminal and a second current path for providing said source current, wherein said second current path is coupled to said second matched resistor; and an amplifier having two inputs coupled to said first and second matched resistors, respectively, and an output coupled to said control terminal of said second controlled switch;

wherein said amplifier serves as a voltage follower for controlling said second controlled switch to equalize the current flow through said first and second matched resistors.

5. The combined voltage and current source of claim 4, wherein said first and second controlled switches comprise transistors.

6. The combined voltage and current source of claim 5, wherein said first and second controlled switches comprise MOSFETS.

7. The combined voltage and current source of claim 1, wherein said voltage source circuit comprises:

a voltage regulator having an adjust control input and an output for asserting said source voltage; and wherein said reference amplifier has an output coupled to said adjust control input and a feedback input coupled to said output of said voltage regulator when said reference amplifier is coupled to said voltage source circuit, so that said reference amplifier controls said voltage regulator to provide said source voltage to correspond to said reference voltage.

8. The combined voltage and current source of claim 7, wherein said voltage source circuit further comprises:

means for providing a negative supply voltage;

said adjust input of said voltage regulator further coupled to said negative supply voltage through a first current limiter; and a rectifier having an anode coupled to the output of said voltage regulator and further coupled to said adjust terminal through a second current limiter, said rectifier having a cathode for providing said source voltage;

wherein said rectifier is forward biased when said voltage source circuit is selected, but otherwise reversed biased for isolation purposes through said first and second current limiters to said negative rail supply voltage when said voltage source circuit is not selected.

9. The combined voltage and current source of claim 8, wherein said rectifier comprises a low leakage diode.

10. The combined voltage and current source of claim 8, further comprising a second rectifier coupled between said adjust terminal and said first current limiter.

11. The combined voltage and current source of claim 1, wherein said switch circuit further comprises:

a first switch receiving a first select signal for selecting said current source circuit; and a second switch receiving a second select signal for selecting said voltage source circuit.

12. The combined voltage and current source of claim 11, wherein said first and second switches comprises CMOS switches.

13. The combined voltage and current source of claim 1, wherein said reference amplifier includes an output and a feedback input, wherein said switch circuit further comprises:

first and second CMOS switches each receiving a current select signal for coupling said output and said feedback input, respectively, of said reference amplifier to said current source circuit; and third and fourth CMOS switches each receiving a voltage select signal for coupling said output and said feedback input, respectively, of said reference amplifier to said voltage source circuit.

14. A measurement system for measuring variable parameters of a process or test unit being monitored or controlled, comprising:

a measurement circuit receiving a source signal and providing an output signal, said measurement circuit including a transducer responsive to one of the variable parameters being measured; and an instrument device coupled to the measurement circuit including a combined voltage and current source for asserting said source signal and for receiving said output signal, comprising:

means for providing a reference voltage;

means for providing at least one select signal;

a reference amplifier receiving said reference voltage;

a current source circuit comprising:

an input for coupling to said reference amplifier;

an output for providing s source current corresponding to said reference voltage when coupled to said reference amplifier;

a first controlled switch having a control input and a first current path; and a reference resistor coupled to said first current path of said first controlled switch;

wherein said reference amplifier has an output coupled to said control input to control the current through said reference resistor;

a voltage source circuit having an input for coupling to said reference amplifier and an output for asserting a source voltage corresponding to said reference voltage when coupled to said reference amplifier; and a switch circuit coupled to said reference amplifier, said current source circuit, and said voltage source circuit and receiving said at least one select signal for selecting between said current source circuit and said voltage source circuit based on said select signal for coupling to said reference amplifier.

15. The measurement circuit of claim 14, wherein said current source circuit output and said voltage source circuit output are connected together to provide said source signal depending on said select signal.

16. The measurement circuit of claim 14, wherein said reference amplifier is coupled as a voltage to current converter when coupled to said current source circuit for establishing a current signal corresponding to said reference voltage.

17. The measurement circuit of claim 14, wherein said voltage source circuit comprises:

a voltage regulator having an adjust control input and an output for asserting said source voltage; and wherein said reference amplifier has an output coupled to said adjust control input and a feedback input coupled to said output of said voltage regulator when said reference amplifier is coupled to said voltage source circuit, so that said reference amplifier controls said voltage regulator to provide said source voltage to correspond to said reference voltage.

18. The measurement circuit of claim 14, wherein said reference amplifier includes an output and a feedback input, wherein said switch circuit further comprises:

first and second switches each receiving a current select signal for coupling said output and said feedback input, respectively, of said reference amplifier to said current source circuit; and third and fourth switches each receiving a voltage select signal for coupling said output and said feedback input, respectively, of said reference amplifier to said voltage source circuit.

19. The measurement circuit of claim 18, wherein said first, second, third and fourth switches are CMOS type switches.

20. A measurement system for measuring variable parameters of a unit under test, comprising:

a unit under test receiving a source signal and providing an output signal, said unit under test being having a variable parameter being measured; and an instrument device coupled to the unit under test including a combined voltage and current source for asserting said source signal and for receiving said output signal, comprising:

a reference amplifier receiving a reference voltage;

a current source circuit comprising:

an input for coupling to said reference amplifier;

an output for providing a source current corresponding to said reference voltage when coupled to said reference amplifier;

a first controlled switch having a control input and a first current path; and a reference resistor coupled to said first current path of said first controlled switch;

wherein said reference amplifier has and output coupled to said control input to control the current through said reference resistor;

a voltage source circuit having an input for coupling to said reference amplifier and an output for asserting a source voltage corresponding to said reference voltage when coupled to said reference amplifier; and a switch circuit coupled to said reference amplifier, said current source circuit, and said voltage source circuit and receiving at least one select signal for selecting between said current source circuit and said voltage source circuit based on said select signal for coupling to said reference amplifier.

21. The measurement circuit of claim 20, wherein said current source circuit output and said voltage source circuit output are connected together to provide said source signal depending on said select signal.

22. The measurement circuit of claim 20, wherein said reference amplifier is coupled as a voltage to current converter when coupled to said current source circuit for establishing a current signal corresponding to said reference voltage.

23. The measurement circuit of claim 20, wherein said voltage source circuit comprises:

a voltage regulator having an adjust control input and an output for asserting said source voltage; and wherein said reference amplifier has an output coupled to said adjust control input and a feedback input coupled to said output of said voltage regulator when said reference amplifier is coupled to said voltage source circuit, so that said reference amplifier controls said voltage regulator to provide said source voltage to correspond to said reference voltage.

24. The measurement circuit of claim 20, wherein said reference amplifier includes an output and a feedback input, wherein said switch circuit further comprises:

first and second switches each receiving a current select signal for coupling said output and said feedback input, respectively, of said reference amplifier to said current source circuit; and third and fourth switches each receiving a voltage select signal for coupling said output and said feedback input, respectively, of said reference amplifier to said voltage source circuit.

25. The measurement circuit of claim 24, wherein said first, second, third and fourth switches are CMOS type switches.

26. A combined voltage and current source for a measurement system, comprising:

a reference amplifier receiving s reference voltage;

a current source circuit having an input for coupling to said reference amplifier end an output for providing a source current corresponding to said reference voltage when coupled to said reference amplifier;

a voltage source circuit comprising:

an input for coupling to said reference amplifier;

an output for asserting a source voltage corresponding to said reference voltage when coupled to said reference amplifier;

a voltage regulate having an adjust control input and an output for asserting said source voltage;

wherein said reference amplifier has an output coupled to said adjust control input and a feedback input coupled m said output of said voltage regulator when said reference amplifier is coupled to said voltage source circuit, so that said reference amplifier controls said voltage regulator to provide said source voltage to correspond to said reference voltage; and a switch circuit coupled to the current source circuit and the voltage source circuit, the switch circuit receiving at least one select signal and coupled to said reference amplifier to select between said current source circuit and said voltage source circuit based on said select signal for coupling to said reference amplifier.

27. The combined voltage and current source of claim 26, wherein said voltage source circuit further comprises:

means for providing a negative supply voltage;

said adjust input of said voltage regulator further coupled to said negative supply voltage through a first current limiter; and a rectifier having an anode coupled to the output of said voltage regulator and further coupled to said adjust terminal through a second current limiter, said rectifier having a cathode for providing said source voltage;

wherein said rectifier is forward biased when said voltage source circuit is selected, but otherwise reversed biased for isolation purposes through said first and second current limiters to said negative rail supply voltage when said voltage source circuit is not selected.

28. An instrument for measuring variable parameters of a unit under test, comprising:

a combined voltage and current source for asserting a source signal to the unit under test and for receiving an output signal from the unit under test, comprising:

a reference amplifier receiving a reference voltage;

a current source circuit comprising:

an input for coupling to said reference amplifier;

an output for providing a source current corresponding to said reference voltage when coupled to said reference amplifier;

a first controlled switch having a control input and a first current path; and a reference resistor coupled to said first current path of said first controlled switch;

wherein said reference amplifier has an output coupled to said control input to control the current through said reference resistor;

a voltage source circuit having an input for coupling to said reference amplifier and an output for asserting a source voltage corresponding to said reference voltage when coupled to said reference amplifier; and a switch circuit coupled to said reference amplifier, said current source circuit, and said voltage source circuit and receiving said at least one select signal for selecting between said current source circuit and said voltage source circuit based on said select signal for coupling to said reference amplifier;

an output port for providing the source signal to the unit under test; and an input port for receiving the output signal from the unit under test.

* * * * *

UNITED STATES PATENT AND TRADEMARK OFFICE

CERTIFICATE OF CORRECTION

PATENT NO. : 5,654,654

DATED : August 5, 1997

INVENTOR(S) : Michael R. Franklin

It is certified that error appears in the above-indentified patent and that said Letters Patent is hereby corrected as shown below:

Claim 14, col. 9, line 10, please replace the word "s" with "a".

Claim 20, col. 10, line 15, please replace the word "and" with "an".

Claim 26, col. 10, line 66, please replace the word "end" with "and".

Claim 26, col. 11, line 8, please replace the word "regulate" with "regulator".

Claim 26, col. 11, line 12, please replace the word "m" with "to".

Signed and Sealed this

Eighteenth Day of November 1997

*Attest:*

Bruce Lehman

BRUCE LEHMAN

*Attesting Officer*

*Commissioner of Patents and Trademarks*